US005667613A

United States Patent [19]

Fantino et al.

[11] Patent Number: 5,667,613

[45] Date of Patent: Sep. 16, 1997

[54] METHOD FOR PRODUCING A REINFORCEMENT IN THE FORM OF A BLOCK FOR A COMPOSITE COMPONENT

[75] Inventors: Lucien Fantino, Merignac; Georges Cahuzac, Le'Bouscat, both of France

[73] Assignee: Aerospatiale Societe Nationale Industrielle, Paris, France

[21] Appl. No.: 421,558

[22] Filed: Apr. 13, 1995

[30] Foreign Application Priority Data

Apr. 18, 1994 [FR] France ..... 94 04583

[51] Int. Cl.[6] ..... B32B 31/00

[52] U.S. Cl. ..... 156/182; 112/412; 112/415; 156/178; 156/179; 156/181; 428/102

[58] Field of Search ..... 156/148, 163, 156/178, 179, 181, 182; 428/102, 300; 112/412, 415, 420, 440

[56] References Cited

U.S. PATENT DOCUMENTS

| | | | |
|---|---|---|---|
| 3,322,868 | 5/1967 | Kruse et al. | 264/45 |
| 3,425,884 | 2/1969 | Brinkema | 156/161 |
| 3,955,602 | 5/1976 | King | 139/11 |
| 4,038,440 | 7/1977 | King | 428/245 |
| 4,218,276 | 8/1980 | King | 156/92 |

FOREIGN PATENT DOCUMENTS

| | | |
|---|---|---|
| 0547738 | 6/1993 | European Pat. Off. . |
| 2159460 | 12/1985 | United Kingdom . |

OTHER PUBLICATIONS

French Search Report dated Jan. 19, 1995, 3 pages.

*Primary Examiner*—James J. Bell
*Attorney, Agent, or Firm*—Marshall, O'Toole, Gerstein, Murray & Borun

[57] ABSTRACT

The present invention relates to a method and a machine for producing a reinforcement in the form of a block for a composite component formed by said reinforcement embedded in a cured matrix.

According to the invention, said block (B) is made up by continuously forming a succession of superposed sheets, and the machine, comprising a stand provided with a subframe and with uprights for mounting at least one frame which can move along said uprights, capable of receiving a thread laying-down tool which can move in a plane transverse to said uprights, is noteworthy in that it comprises an additional frame (6) which can move along said uprights (4) and is provided with pegs (9) for hooking on said straight portions of thread (F).

7 Claims, 4 Drawing Sheets

1
2
3
4
5
6
7
9
11
13
14
15
26
27
28
29
29A
F
F1
Z
B

METHOD FOR PRODUCING A REINFORCEMENT IN THE FORM OF A BLOCK FOR A COMPOSITE COMPONENT

The present invention relates to a method for producing a reinforcement in the form of a block for a composite component, formed by said reinforcement embedded in a cured matrix, said reinforcement including superposed plies of thread (especially carbon, glass or boron thread) and to a machine for implementing said method, as well as to a reinforcement and a composite component which are thus obtained.

More particularly, although not exclusively, such composite components will be used, after machining, in the aeronautical, space and nuclear fields by virtue of their excellent properties of resistance to mechanical and/or thermal stresses.

Many methods are known for obtaining composite components, and especially their reinforcement. In general, the first step is to produce the reinforcement from fibers (threads), in particular inorganic fibers, distributed in at least two directions, after which the material of the matrix is injected into the reinforcement and said material is cured in order to form said matrix and, thus, said composite component.

More specifically, in the present case, the term "block" denotes an object whose thickness or height represents at least a significant fraction of the longitudinal dimensions (length, width; diameter) of the object.

In order to produce such blocks, especially according to U.S. Pat. No. 3,955,602 and U.S. Pat. No. 4,218,276, it is necessary to give substance to the vertical direction, corresponding to the thickness or to the height of the block, by means of rods, especially metal rods, between which horizontal plies of thread are inserted and compacted. Such a way of doing this requires using a large number of such rods, which have to be replaced by thread at the end of the superposition of the horizontal plies of thread. This is therefore a principle which is very restricting and inflexible.

A similar method is described in Patent FR2,531,459, in which method an array of small rigid bars or rods is initially formed, between which small bars or rods a thread is laid down which forms successive layers that are superposed in planes transverse to the direction of the small bars. Likewise, after producing the desired reinforcement, the small bars are replaced with thread of the same kind, forcing them out of the reinforcement beforehand using a long needle, which needle next hooks onto a thread and pulls it through the reinforcement, replacing the small bar which has just been forced out. It might be imagined that this method requires an apparatus which is complex, bulky (the reinforcement must be raised up in order to clear a space for removing the needles) and fragile (the needle must have a length corresponding to that of the small bars). Correlatively, the height of the components obtained by this method is necessarily limited. Notwithstanding, this method, although more flexible than the previous ones for orienting the horizontal plies, requires having, on the one hand, to calibrate the lengths of thread laid down and, on the other hand, to also give substance to the vertical direction in the form of an array of metal rods.

The object of the present invention is to overcome these drawbacks and relates to a method for producing a reinforcement in the form of a composite component, by means of which it is no longer necessary to use metal rods for giving substance to the vertical direction (thickness or height of the block) and, finally, to replace them. Moreover, the tooling necessary for implementing the method is considerably simplified.

For this purpose, the method for producing a reinforcement in the form of a block for a composite component formed by said reinforcement embedded in a cured matrix, is noteworthy, according to the invention, in that said block is made up by continuously forming a succession of superposed sheets, each sheet itself comprising superposed plies of thread which are produced by arranging, for each ply, straight portions of thread at least substantially in a parallel fashion with respect to each other, the straight portions of thread of each ply extending in a direction which is either parallel or crossed with respect to the direction of the straight portions of thread of any other ply in the sheet, and by consolidating all the superposed plies using a thread passing through said plies, and in that each sheet is consolidated with the immediately subjacent sheet by the thread for consolidating the superposed plies of the sheet in question and with the immediately superjacent sheet by the thread for consolidating the superposed plies of said superjacent sheet.

Thus, it is possible to produce a reinforcement in the form of a block of large dimension (height or thickness) from a continuously and "in situ" manufactured succession of woven sheets (filling-in) joined together by transverse stitching.

Advantageously, the superposed plies of each sheet are compacted by mechanical pressure and, in order to maintain the state of compaction of said plies that is thus obtained, the ply-consolidating thread is stitched, without knotting, through said plies, forming stitches over at least the major part of the surface of said plies, these plies having, after compaction, a density of the portions of thread constituting them which is sufficient to retain said consolidating thread by means of friction.

In particular, each of said straight portions of thread may be pulled tight between two points for positionally fixing the ends of said portion.

Preferably, each positional fixing point is manifested by a peg around which passes the junction between two straight portions of thread of the same direction but of opposite senses.

According to another characteristic of the invention, after producing a sheet, all the pegs are unhooked from said sheet and are raised up by a distance corresponding to the thickness of said sheet.

According to yet another characteristic of the invention, the lowermost sheet of the block is produced on a support of soft material, such as a foam of synthetic material.

The present invention also relates to a machine for implementing the method which has just been described, of the type comprising a stand provided with a subframe and with uprights for mounting at least one frame which can move along said uprights, capable of receiving a thread laying-down tool which can move in a plane transverse to said uprights, which machine is noteworthy, according to the invention, in that it comprises an additional frame which can move along said uprights and is provided with pegs for hooking on said straight portions of thread.

Although other shapes, especially a cylindrical shape, may be envisaged (with corresponding frames, especially a circular frame) for producing, in particular, a block of parallelepipedal shape, said additional frame has a quadrilateral shape, each side of said frame including a series of said pegs.

In this case, advantageously, each series of pegs is mounted on a rotary spindle for retracting it.

Preferably, each peg has the shape of a hook, the free end part of which is outwardly curved over.

According to another characteristic of the machine of the invention, the thread laying-down tool has a rigid tube extended by a flexible tube, the thread passing through said tubes.

Moreover, the machine may include a stitching head having a rotary support at the lower end of which a needle, associated with a presser-foot, is mounted.

The figures of the appended drawing will make it clear how the invention can be realized.

Figure 1:
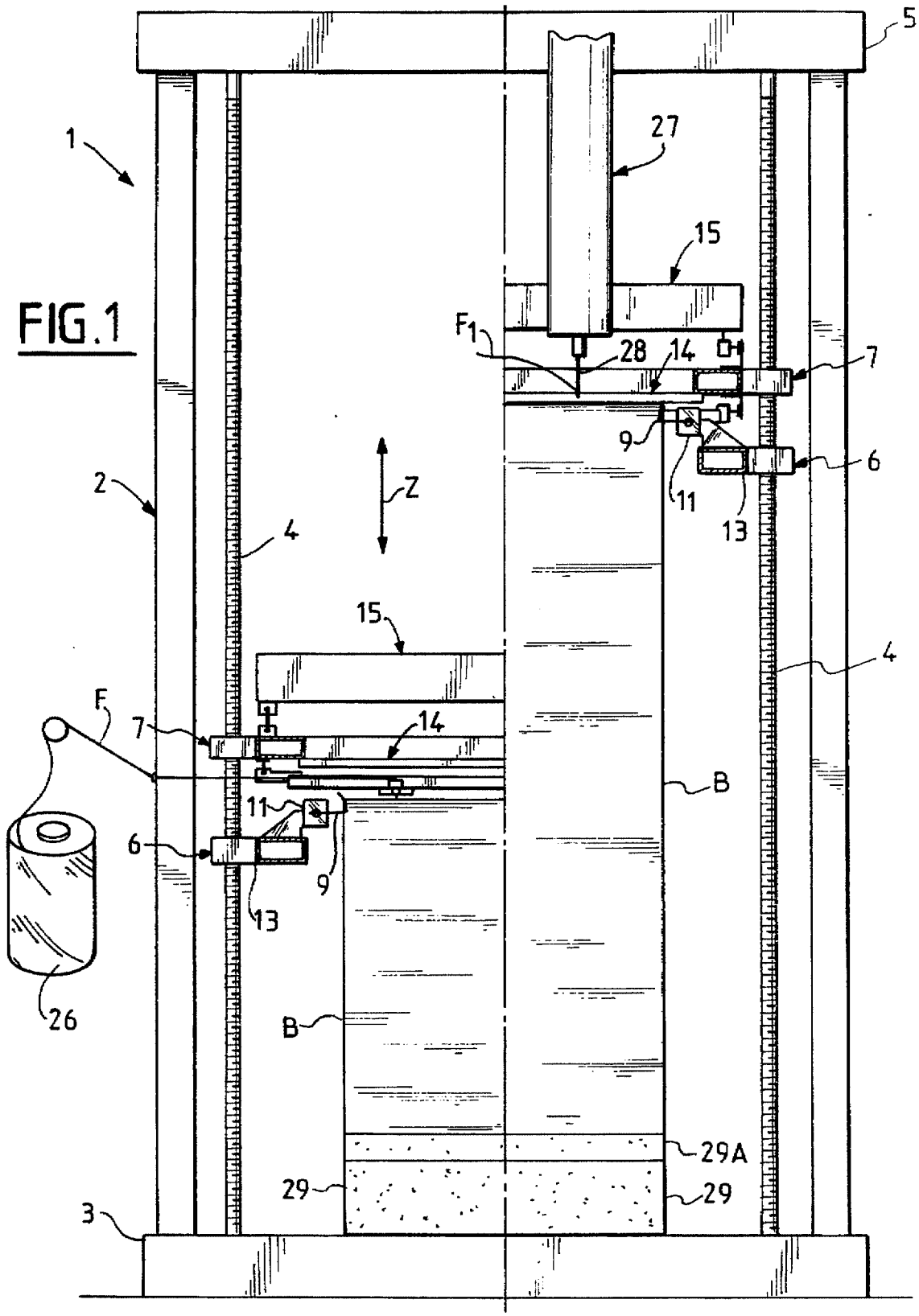
FIG. 1 is a diagrammatic view, in elevation, of an example of a machine for implementing the method according to the invention, the left half of which corresponds to a filling-in phase (laying down a thread) and the right half to a stitching phase.

The machine 1 of FIG. 1 comprises a stand 2 provided with a subframe 3 and with uprights 4 joining the subframe 3 and the top part 5 of the machine. The uprights 4, being especially four in number, may be produced, as represented, in the form of threaded rods and allow mounting of the frames 6, 7 which can move along said uprights parallel to the Z direction. Although this is not represented, for reasons of clarity of the drawing, each frame 6, 7 comprises a motor which drives four nuts via a chain, each corresponding to one threaded rod, which allow these frames to move translationally along the (advantageously vertical) Z direction.

Figure 2:
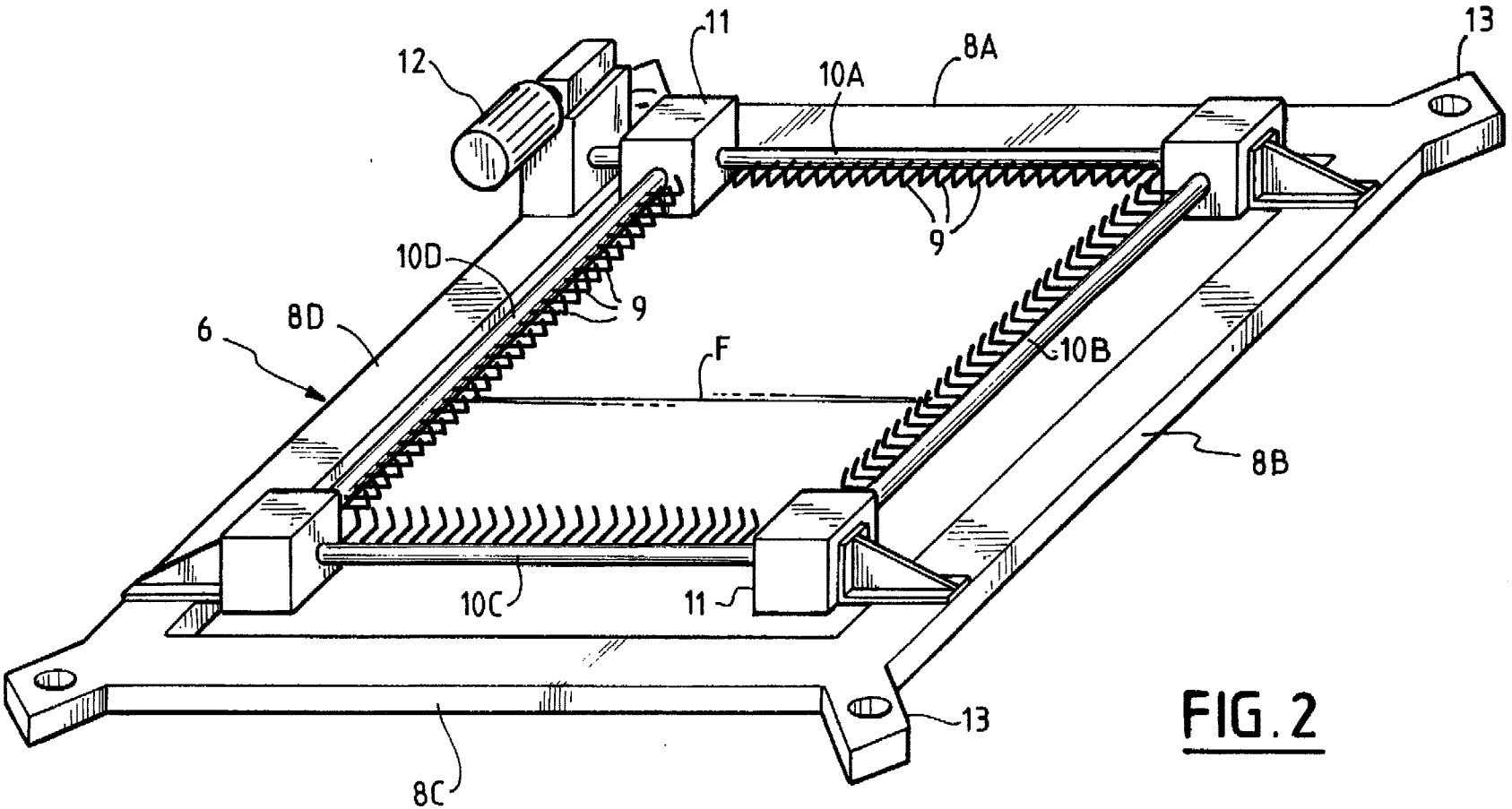
FIG. 2 is a diagrammatic perspective view of a quadrilateral frame carrying the pegs for hooking on the thread.

More particularly, the lower frame 6, as may be better seen in FIG. 2, has a quadrilateral shape, each side 8A, 8B, 8C, 8D of the frame 6 comprising a series of pegs 9, each series of pegs being mounted on a rotary spindle 10A, 10B, 10C, 10D. Said spindles are connected to four angle gear drives 11 arranged in the corners. One of the outputs of these angle gear drives is connected to a gear motor 12. A contact (not represented) fixed to this output allows the motor to stop in the filling-in position of the hooks. Moreover, the feet 13 for mounting the frame 6 on the uprights 4 have been represented at the corners of the sides 8A–8D. As may be seen better in FIG. 4, each peg 9 is in the form of a hook, the free end part 9A of which is outwardly curved over, in order to facilitate the filling-in with the thread, preventing the latter from rising up and the retraction of the pegs by rotating in the direction of the arrow P in FIG. 4.

Figure 3:
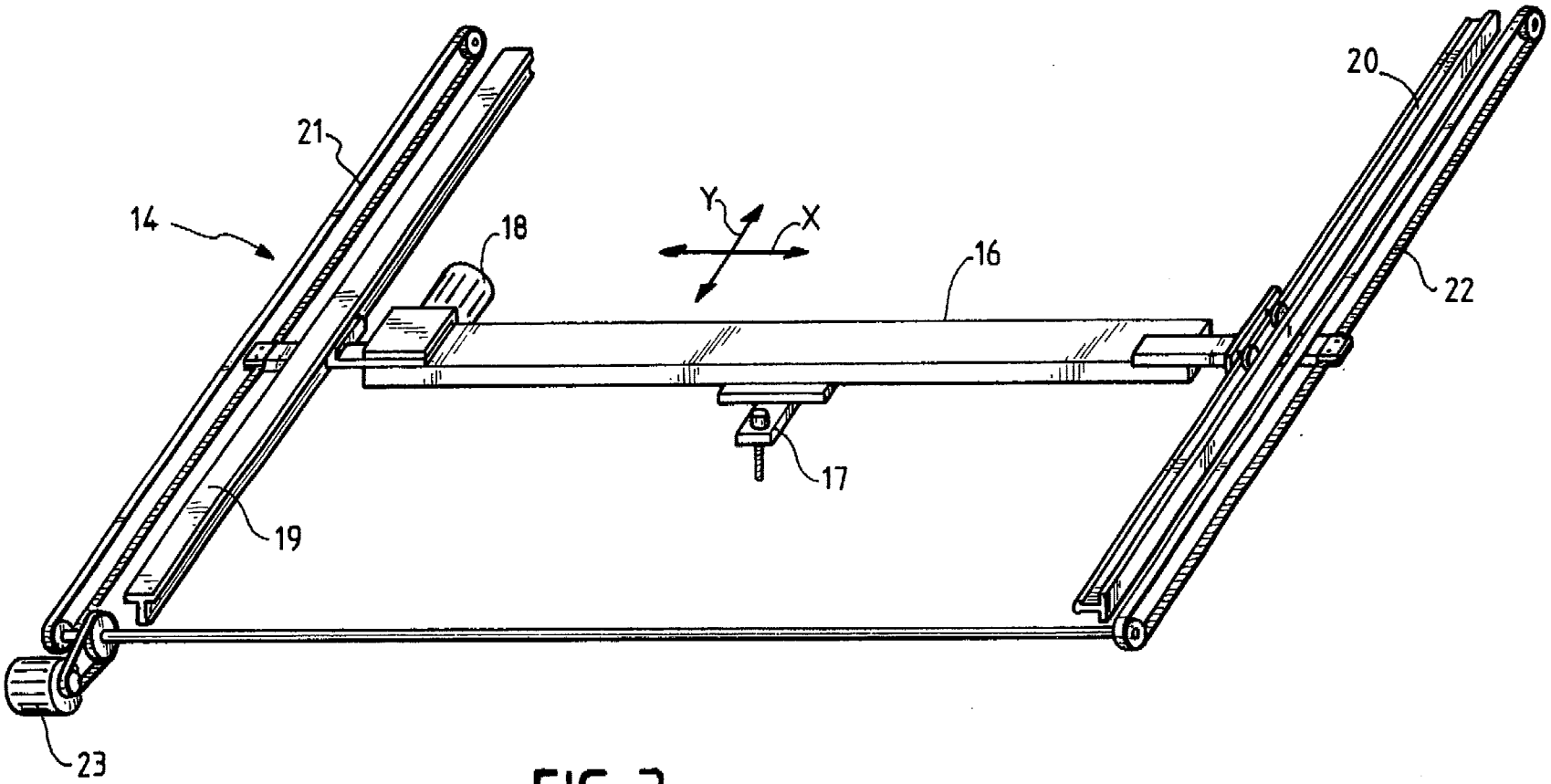
FIG. 3 is a diagrammatic perspective view of the thread laying-down tool, on its frame, of the machine of the invention.

The upper frame 7 comprises two carriages 14,15 which can move in the plane, transversely to the Z direction, defined by the two X,Y directions (see FIG. 3). The lower carriage 14 (FIG. 3) includes a bar 16, extending in the X direction, along which bar the thread laying-down tool 17 may move, under the action of a motor 18, by way of a drive belt, not represented. Moreover, the bar 16 can move in the Y direction, orthogonal to the X direction, its ends running on guide rails 19,20, fixed to the frame 7, under the action of drive belts 21,22 set into motion by a motor 23 which is also firmly attached to the frame 7. The thread laying-down tool 17 may thus move in the X,Y directions, to any point in the plane bounded by the rails 19,20.

More particularly, the thread laying-down tool has a rigid tube 24 extended by a flexible tube 25, the thread F, going from a bobbin 26 (FIG. 1), passing through said tubes 24,25.

In addition, the upper carriage 15 carries a stitching head 27 having a rotary support at the lower end of which a needle 28, preferably associated with a presser-foot (not represented), is mounted.

It should be noted that a thread laying-down tool and a stitching head, which are particularly appropriate for being used in a machine of this type, are described in detail in the French patent application, filed on Apr. 18 1994 in the name of the Applicant Company, for "Method and machine for producing a reinforcement in the form of a sheet for a composite component".

This machine is controlled by an NC director consisting of an axis card capable of controlling eight motors plus sixteen on/off inputs and sixteen on/off outputs. This card is installed in a computer which serves to forward to the card the data necessary for constructing a block.

A block B is produced in the following way, according to the invention.

A foam support 29 of a suitable height is arranged on the subframe 3 of the machine. The two frames 6 and 7 are put into relative position so that the thread laying-down tool 17 places the thread F in the hooks 9. This may, especially, be performed in accordance with the method described in the French patent application mentioned hereinabove, and is illustrated diagrammatically in FIG. 2.

A filling-in program is executed, which program controls the laying-down of the plies of thread until all the hooks are furnished with portions of thread. This corresponds to a sheet 30 (FIG. 4) having a height of approximately 3 cm, for example.

Next, the transverse bar 16, carrying the carriage (FIG. 3) to which the thread laying-down tool 17 is fixed, is retracted into the front or rear position so as to leave room for the stitching head 27.

Figure 4:
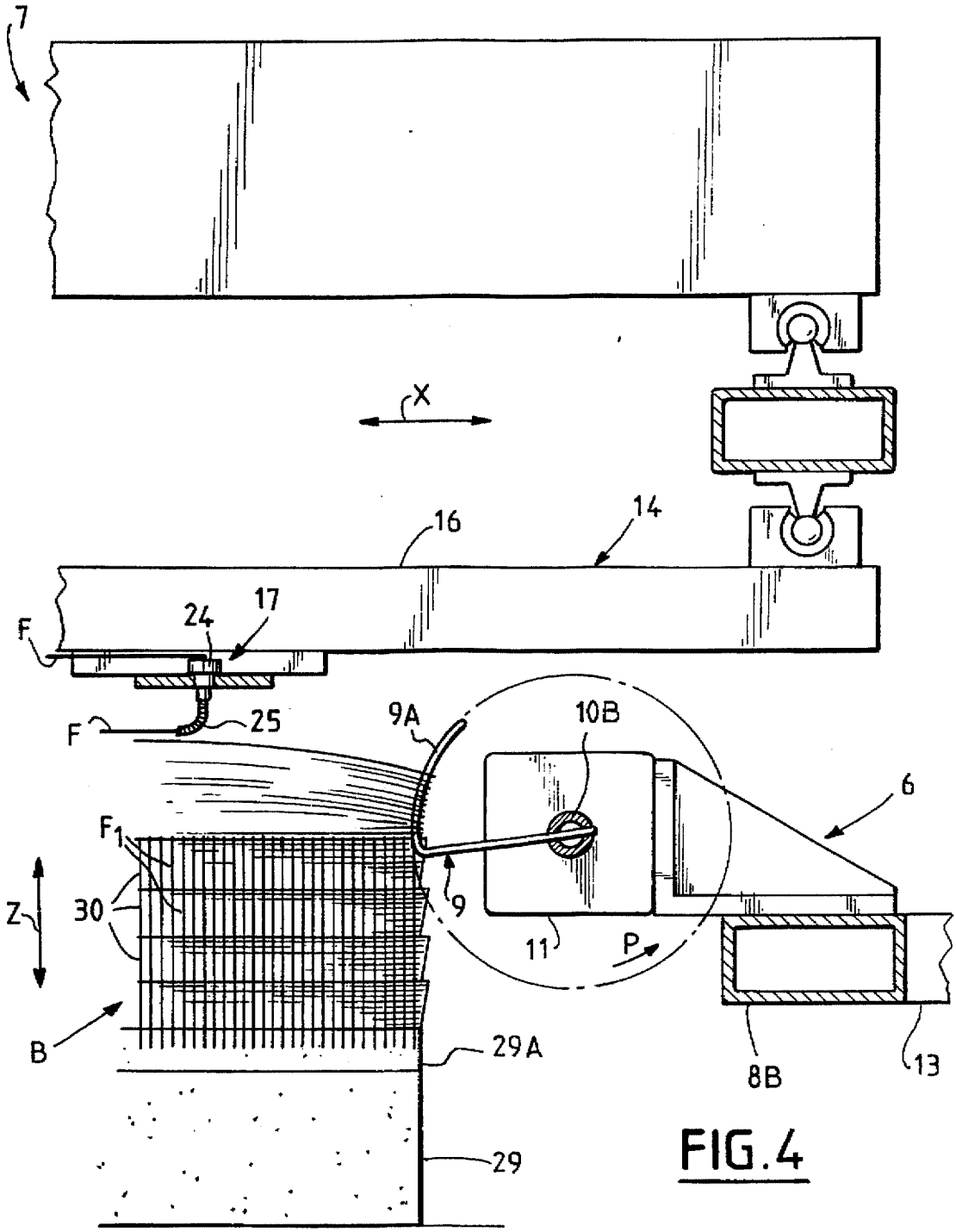
FIG. 4 shows an enlarged detail of the machine of FIG. 1.

Stitching is then executed, especially in the manner described in the French patent application mentioned hereinabove, this compacting the plies laid down. At the same time, each sheet 30 is consolidated with the immediately subjacent sheet by the thread F1 for consolidating the superposed plies of the sheet in question and with the immediately superjacent sheet by the thread F1 for consolidating the superposed plies of said superjacent sheet (FIG. 4).

The spindles 10A–10D carrying the hooks 9 are then rotated, this having the effect of unhooking the filled-in portions of thread F which remain fixed by the portions of thread F1 which are stitched to the previously laid-down plies.

It is then possible to raise the lower frame 6 by the height of the laid-down plies of thread, corresponding to one sheet, and to complete the rotation of the spindles 10A–10D in order to be able to start the filling-in operation (laying down of thread) again. Each sheet thus comprises superposed plies of thread which are produced by arranging, for each ply, Straight portions of thread at least substantially in a parallel fashion with respect to each other, the straight portions of thread of each ply extending in a direction which is either parallel or crossed with respect to the direction of the straight portions of thread of any other ply in the sheet, and all the superposed plies are consolidated by using a thread passing through said plies.

Moreover, the superposed plies of each sheet 30 are compacted by mechanical pressure and, in order to maintain the state of compaction of said plies that is thus obtained, the ply-consolidating thread F1 is stitched, without knotting, through said plies, forming stitches over at least the major part of the surface of said plies, having, after compaction, a density of the portions of thread constituting them which is sufficient to retain said consolidating thread by means of friction. In this regard, the filling-in thread F may constitute from 40 to 60% and the consolidating thread F1 from 1 to 10% of the total volume of the component (reinforcement plus matrix).

The block therefore rises in stages. It is formed by a succession of "slices" (sheets) linked together by the stitching levels.

When the desired height is reached, the block is then taken out of the machine by removing the lower foam 29 and taking away the foam 29A, which is torn.

The size of the blocks produced on the machine may be, for example, 800 mm×800 mm×2000 mm, i.e. a weight of 1300 kg (related to the capacity of the machine).

In the current application, this block (reinforcement or woven substrate, neither impregnated nor densified) is cut up into slices by sawing with a bandsaw, like a tree trunk, so as to obtain "planks" comprising the majority of the threads perpendicular to the length of the plank, so as to favor thermal conduction between the two faces.

Thus, the method of the invention makes it possible to produce a fibrous preform or reinforcement (before impregnation and densification) of large dimension (height) from a succession of woven sheets (filling-in) which are joined together by stitching.

The large block produced may then be cut up into various elements or small blocks or sheets, depending on the type of application (use) envisaged (because of the good coherence of the stitching in the vertical direction, Z).

One of the advantageous applications is the production of a block whose thermal conductivity in one direction in the carbon/carbon composite is very high. In order to achieve this, the percentage of fibers (threads) in a desired direction is increased. In addition, it is possible to use pitch fibers (whose conductivity is greater than that of graphite).

The blocks thus produced make it possible to replace the graphite commonly used in the nuclear field, for example.

In this case, sheets are obtained which have a high transverse (Z) thermal conduction by increasing the density of transverse (stitching) threads (this being relatively low in the XY plane of the component).

The idle time of the machine, between making two components, is very short since the startup operation is very simple. Very fine meshes may be produced, since the thickness of the vertical threads is small, of the order of 0.2 mm, and the spacing of the vertical threads depends only on the programming of the movements of the stitching head and not on the complex tooling (allowing production of fine-spacing blocks). This method also allows the horizontal plies of thread to be placed in any orientation in the plane (there is no longer limitation to two or three directions, since the thread laying-down tool is programmed and it can move in the desired direction).

As already indicated, one of the products which may be obtained by means of this method is a material which is thermally more conductive than graphite and less brittle. This conduction must be obtained between the two faces of the material.

We claim:

1. A method for producing a reinforcement in the form of a block for a composite component, said method comprising the steps of:

(a) forming a first sheet comprising superposed plies of thread which are produced by arranging, for each ply of said first sheet, straight portions of thread at least substantially in a parallel fashion with respect to each other, the straight portions of thread of each ply of said first sheet extending in a direction which is either parallel or crossed with respect to the direction of the straight portions of thread of any other ply in said first sheet and consolidating thread which passes through a plurality of said plies of said first sheet;

(b) after said step (a), forming a second sheet comprising superposed plies of thread which are produced by arranging, for each ply of said second sheet, straight portions of thread at least substantially in a parallel fashion with respect to each other, the straight portions of thread of each ply of said second sheet extending in a direction which is either parallel or crossed with respect to the direction of the straight portions of thread of any other ply in said second sheet; and (c) after said step (b), consolidating said first sheet and said second sheet with thread that passes through a plurality of said plies of said second sheet and a plurality of said plies of said first sheet.

2. A method as defined in claim 1 additionally comprising the step of compacting said plies of each sheet by mechanical pressure and, in order to maintain the state of compaction of said plies, stitching said consolidating thread through said plies, without knotting, to form stitches over at least a major part of the surface of said plies, said plies having, after compaction, a density which is sufficient to retain said consolidating thread by means of friction.

3. A method as defined in claim 1 wherein each of said straight portions of thread is pulled tight between a pair of points for positionally fixing the ends of said straight portions.

4. A method as defined in claim 1 wherein each of said straight portions of thread is pulled tight between a pair of pegs for positionally fixing the ends of said straight portions.

5. A method as defined in claim 4 additionally comprising the steps of unhooking one of said sheets from said pegs after said one sheet is produced and raising said pegs up by a distance corresponding to the thickness of one of said sheets.

6. A method as defined in claim 1 wherein one of said sheets is produced on a support of soft material.

7. A method as defined in claim 1, additionally comprising the steps of:

(d) repeating said step (b) to form a third sheet comprising superposed plies of thread which are produced by arranging, for each ply of said third sheet, straight portions of thread at least substantially in a parallel fashion with respect to each other, the straight portions of thread of each ply of said third sheet extending in a direction which is either parallel or crossed with respect to the direction of the straight portions of thread of any other ply in said third sheet; and (e) after said step (d), consolidating said second sheet and said third sheet with thread that passes through a plurality of said plies of said third sheet and a plurality of said plies of said second sheet.

* * * * *